United States Patent [19]

Dawson

[11] 3,996,905

[45] Dec. 14, 1976

[54] VACUUM CONTROLS FOR INTERNAL COMBUSTION ENGINES

[75] Inventor: Gary D. Dawson, Rochester, Mich.

[73] Assignee: Chrysler Corporation, Highland Park, Mich.

[22] Filed: Nov. 25, 1974

[21] Appl. No.: 526,499

[52] U.S. Cl. ..... 123/119 A; 137/627.5; 251/48

[51] Int. Cl.[2] ..... F02B 33/00; F02M 7/00

[58] Field of Search ..... 123/119 A; 137/627.5; 251/48

[56] References Cited

UNITED STATES PATENTS

| | | | |
|---|---|---|---|
| 3,542,004 | 11/1970 | Cornelius | 123/119 A |
| 3,646,764 | 3/1972 | Nakajima et al. | 123/119 A |
| 3,722,851 | 3/1973 | Love | 137/624.14 |
| 3,739,797 | 6/1973 | Caldwell | 123/119 A |
| 3,773,023 | 11/1973 | Taylor | 123/119 F |
| 3,812,832 | 5/1974 | Scott | 123/119 A |
| 3,818,880 | 6/1974 | Dawson et al. | 123/119 A |
| 3,861,642 | 1/1975 | Maddocks | 123/119 A |
| 3,880,129 | 4/1975 | Hollis | 123/119 A |
| 3,901,202 | 8/1975 | Hollis et al. | 123/119 A |
| 3,926,161 | 12/1975 | Wertheimer | 123/119 A |

FOREIGN PATENTS OR APPLICATIONS

| | | | |
|---|---|---|---|
| 677,469 | 8/1952 | United Kingdom | 137/624.14 |

*Primary Examiner*—Charles J. Myhre
*Assistant Examiner*—Paul Devinsky
*Attorney, Agent, or Firm*—Talburtt & Baldwin

[57] ABSTRACT

A vacuum control system sourced by engine manifold vacuum particularly for exhaust gas recirculation (EGR) systems and carburetor idle enrichment systems wherein a timer means delays system operation for a predetermined period following engine start-up.

2 Claims, 4 Drawing Figures

VACUUM CONTROLS FOR INTERNAL COMBUSTION ENGINES

BACKGROUND

This invention is broadly concerned with the time delayed application of engine manifold vacuum to various engine control systems. Specific embodiments of the invention include exhaust gas recirculation control systems and carburetor idle enrichment systems both of which may be combined to provide an overall engine vacuum control system for improved emission control and improved vehicle driveability.

Motor vehicles driven by internal combustion engines make use of exhaust gas recirculation in order to recirculate portions of the internal combustion engine exhaust back to engine combustion chambers for suppressing to some extent the formation of $NO_x$ in the engine exhaust. This introduction of inert substances, i.e., combusted exhaust gas, into the combustion chamber is believed to lower peak combustion temperatures thereby reducing $NO_x$ formation. An EGR valve is used to control recirculation of the exhaust gas. The valve is typically a vacuum operated valve.

Carburetor idle enrichment systems are desirable additions to carburetor fuel control systems for internal combustion engines since they improve engine operation. Such systems provide a richer fuel/air mixture for a period of time after a cold start. In typical systems enrichment occurs when a vacuum is applied to a diaphragm controlled valve in the carburetor. The valve decreases the amount of air entering the idle air bleed resulting in a richer mixture.

SUMMARY

It is an object of this invention to provide vacuum control systems making use of time delay means.

It is an object of this invention to provide vacuum control systems making use of time delay means for internal combustion engines.

It is an object of this invention to provide vacuum control systems wherein time delay means are utilized with EGR.

It is an object of this invention to provide vacuum control systems wherein time delay means are utilized in conjunction with carburetor idle enrichment control systems.

It is an object of this invention to provide an improved vacuum operated time delay means wherein provision for reset of the timer means is provided by the incorportion of a vacuum relief arrangement which vents a vacuum reservoir or accumulator chamber in the timer means to the vacuum input thereof when the vacuum input signal decreases substantially to a zero level.

DESCRIPTION OF THE PREFERRED EMBODIMENTS

Figure 1:
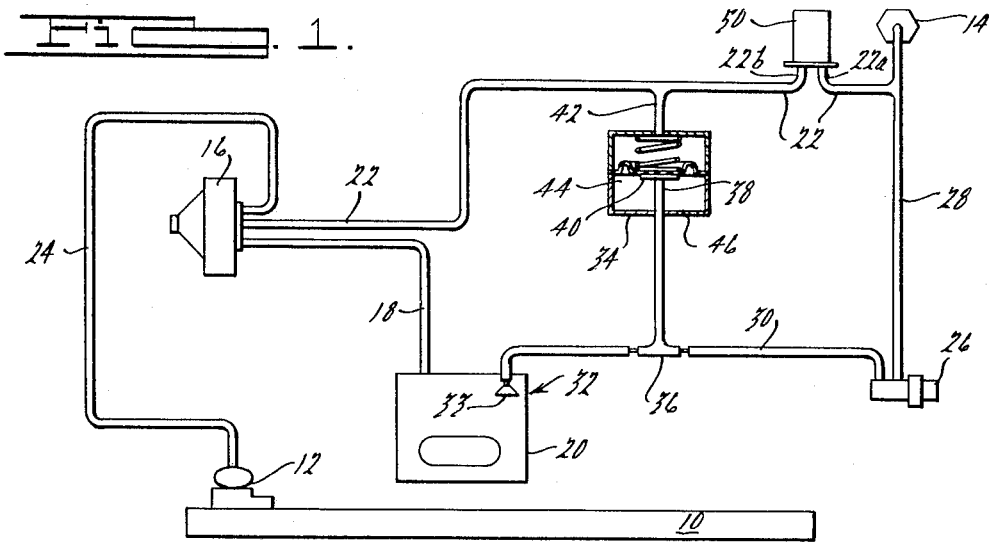
FIG. 1 is a schematic diagram of a vacuum control system for internal combustion engines incorporating both exhaust gas recirculation (EGR) and carburetor idle enrichment wherein utilization of engine manifold vacuum by the system is delayed by a timer arrangement.

The vacuum control system of FIG. 1 is particularly intended for use with motor vehicles driven by internal combustion engines such as engine 10 (schematically shown) in which it is desired to delay operation of an exhaust gas recirculation (EGR) valve 12 for a predetermined period of time, such as 35 seconds after startup of the engine.

Delay is desirable because, when the exhaust gas temperature is low shortly after starting the engine, the E.G.R. mass flow is considerably greater than the system is calibrated for at normal exhaust temperatures. This results in poor driveability. The timer prevents operation of the EGR until the exhaust temperature reaches normal levels.

The vacuum signal for the vacuum control system is provided by engine manifold vacuum source means 14 which may be connected to EGR valve 12 by way of a vacuum amplifier 16 as is described in detail in U.S. Pat. No. 3,818,880. Such a vacuum amplifier makes use of the venturi vacuum provided by vacuum conduit 18 which is appropriately connected to a carburetor 20 as is described in detail in the aforementioned patent. The engine manifold vacuum source means 14 is connected to amplifier 16 by means of vacuum conduit 22. Amplifier 16 provides an operating vacuum signal to EGR valve 12 by way of vacuum conduit 24 as is also described in detail in the aforementioned patent. Briefly, the carburetor venturi vacuum signal modulates the engine manifold vacuum within the amplifier to provide a vacuum control output signal in conduit 24 which is applied to EGR valve 12 to control its operation.

The system shown in FIG. 1 also includes a temperature operated normally open vacuum control valve 26 connected to engine manifold vacuum source means 14 by vacuum conduit 28 which provides vacuum input to valve 26. Valve 26 provides vacuum output via vacuum conduit 30 to carburetor idle enrichment means generally indicated at 32 and including vacuum operated closure means 33 which is operable by means of a vacuum signal in conduit 30 to close an air bleed or relief arrangement in carburetor 20 for a predetermined period of time following engine start up such as a 35 second time delay following which the vacuum signal via conduit 30 is intercepted as described below and the idle enrichment means assumes its normally open position. Enrichment occurs when the vacuum is applied to the vacuum operated closure means 33 such as a diaphragm controlled valve, on carburetor 20. The valve decreases the amount of air entering the idle air bleed (not shown) resulting in a richer mixture. Temperature control valve 26 may be designed to close above a predetermined engine coolant temperature such as 150° F. in order to terminate the vacuum signal to idle enrichment means 32 via conduit 30.

Also, according to this invention, a vacuum operated bleed means 34 is connected into conduit 30 at an orificed T 36. Vacuum bleed means 34 comprises a normally closed orifice or nozzle 38 by means of a spring biased diaphragm 40 which is operable to an open condition by means of vacuum signal through conduit 42 via conduit 22 to relieve vacuum in conduit 30 through nozzle 38 into chamber 44 and then to atmosphere via opening 46.

Vacuum signals in conduit 22 and 42 are provided in a time delayed fashion by means of a vacuum time delay 50 which is connected into conduit 22 as shown in FIG. 1.

Engine manifold vacuum source means 14 provides vacuum input to time delay means 50 at 22a upon engine startup and time delay means 50 provides vacuum output to conduit 22 at 22b after a predetermined time delay period, such as 35 seconds, following engine start up. Time delay means 50 may take the form shown in detail in FIG. 2, which form incorporates a novel reset arrangement in accordance with this invention. The overall specific design shown in FIG. 2 forms no part of this invention except as to the aformentioned reset arrangement.

As previously indicated one specific purpose of vacuum time delay means 50 is to provide a time delay of a predetermined period, such as 35 seconds, after engine start-up, before the engine manifold vacuum is allowed to operate EGR valve 12. It is important that such a timer mechanism include reset means to make certain each time the engine stops, after having started, that the predetermined delay time period is repeated by timer delay means 50. In the case of an EGR valve the delayed time improves the driveability of a motor vehicle without the release of excessive emissions to the atmosphere.

Figure 2:
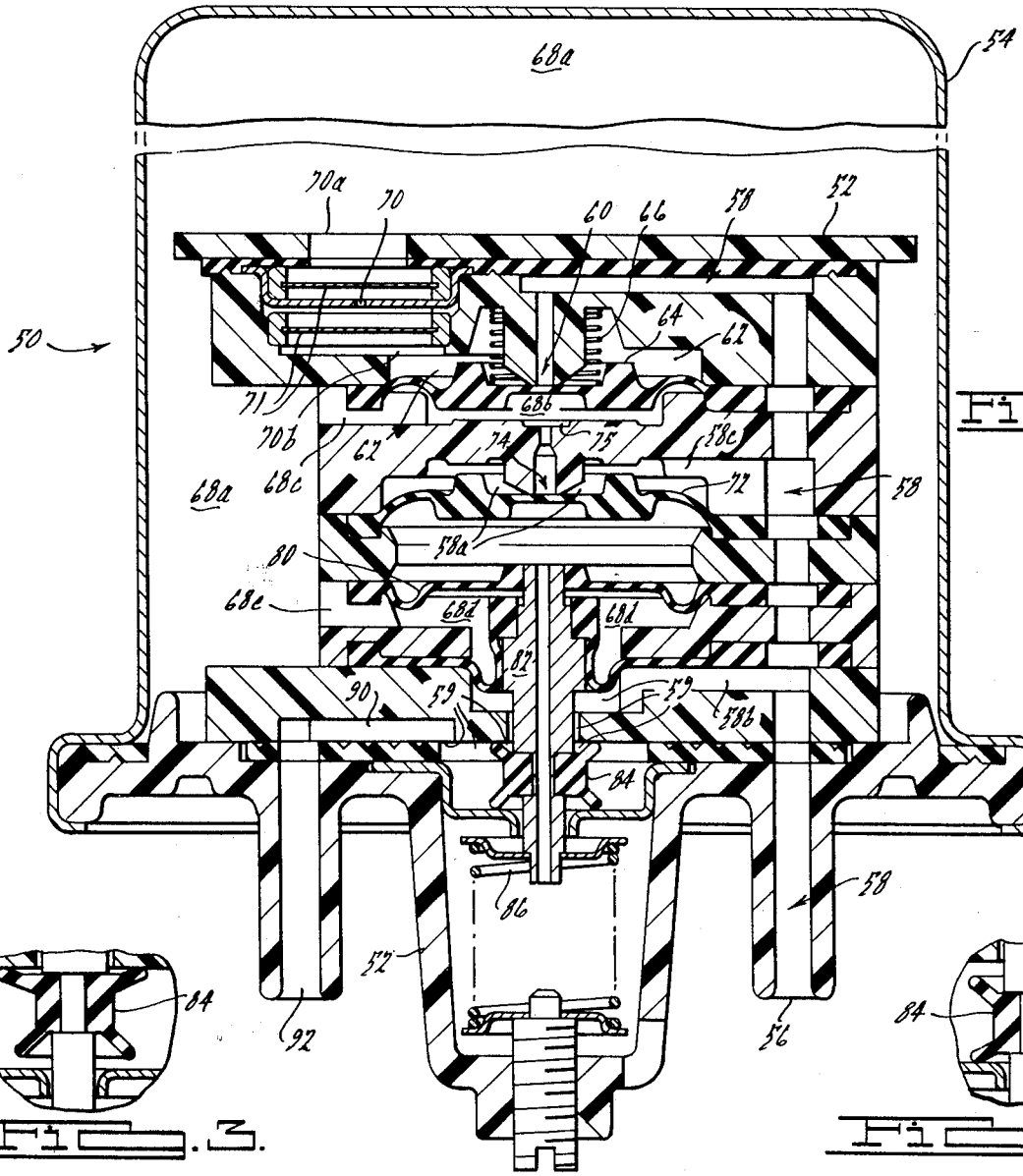
FIG. 2 is a view in cross section of a vacuum timer means incorporating a reset arrangement in accordance with this invention.

Time delay means 50 as shown in FIG. 2 includes a plastic or the like body 52 and a sealed container or can portion 54. Opening into body 52 is a vacuum inlet means 56 providing an input conduit 58 which communicates with several interior portions of the device. Near the top of the device conduit 58 communicates with a manifold vacuum nozzle 60 which opens into a first vacuum chamber means 62. Vacuum regulation in first vacuum chamber means 62 is provided by a diaphragm 64 which is normally open relative to manifold vacuum nozzle 60 since it is normally biased to an open position (not shown in N.O. position) by a suitably arranged biasing spring 66.

First vacuum chamber means 62 communicates with second chamber means, vacuum reservoir means or vacuum accumulator means 68, which is made up of portions 68*a*, 68*b*, 68*c* and 68*d* by means of an interconnecting means or vacuum connector means 70 which takes the form of a small bleed passage means between the two chambers and openings 70*a* and 70*b*. Direct communication is thereby established between chamber 62 and portion 68*a* of 68. Appropriate filters 71 may be used to prevent dirt or the like from blocking orifice 70. By arranging the relative volumes or sizes of chambers 62 and 68 and the relative size of interconnecting bleed means 70 a predetermined time interval can be made to occur before full manifold vacuum at inlet 56, manifold vacuum nozzle 60 and first chamber means 62 can be transferred by way of bleed means 70 to a similar vacuum level in second vacuum chamber means 68. Communication between portion 68*a* and 68*b* may be established by a passage such as 68*c*.

When manifold vacuum is introduced at input 56, normally open diaphragm 64 closes against manifold vacuum nozzle 60 as the manifold vacuum overcomes the biasing load exerted on diaphragm 64 by spring 66. The device is designed such that this occurs when a desired vacuum level is established in chambers 62 and 68.

The vacuum in chamber 62 acts on one side of diaphragm 64 and the vacuum in chamber 68*b* acts on the other. The vacuum in chamber 62 acts on diaphragm 64 to close nozzle 60. The combined forces of spring 66 and the vacuum in chamber 68*b* act on diaphragm 64 to open nozzle 60. Since the effective area of diaphragm 64 is essentially the same relative to the vacuum levels in chamber 62 and 68*b* the differential between chamber 62 and 68*b* is due to the spring force. As the engine is started a vacuum is provided in chamber 62 sufficient to overcome the force of spring 66 causing diaphragm 64 to seal nozzle 60. The vacuum then begins to bleed to chamber 68*a* through orifice 70. The resultant declining vacuum in chamber 62 and increasing vacuum in chamber 68 causes diaphragm 64 to momentarily unseal nozzle 60 and establish a new vacuum level in chamber 62 sufficient to overcome the spring force and the force exerted by the vacuum in chamber 68 on diaphragm 64, thus causing diaphragm 64 to reseal nozzle 60. This cycle action continues until the vacuum in conduit 58, chamber 62, and entire chamber 68 becomes equivalent, assuming the vacuum in conduit 58 is constant. In general 58, 62 and 68 tend to approach equivalency no matter how 58 may be fluctuating.

The cycling occurs with such rapidity as to cause an apparent constant differential between chambers 62 and 68*b*. Stability may ultimately be achieved with a constant input at 58 although the input normally fluctuates.

The vacuum level in chambers 62 and 68 is also affected by a second diaphragm 72 which is normally open (not shown in N.O. position) with respect to reset nozzle 74 which communicates with accumulator vacuum chamber 68*b* at 75. Diaphragm 72 is designed to seat against reset nozzle 74 substantially immediately upon the presence of manifold vacuum in conduit 58 transmitted to chamber 58*a* to seal accumulator chamber 68*b* and hence entire chamber 68 along with first vacuum chamber 62 at reset nozzle 74. Upon cessation of manifold vacuum in conduit 58 diaphragm 72 substantially immediately unseats from reset nozzle 74 venting accumulator chamber 68 and first vacuum chamber 62 to conduit 58 and hence to the manifold vacuum level thus creating a "reset" function in the device and necessitating, upon the restarting of the engine and the renewed presence of the manifold vacuum in input conduit 58, the timed accumulation period or delay period for building up vacuum level in chambers 62 and 68, respectively. Since venting of vacuum chamber 62 occurs through bleed 70 to chamber 68*a* there is a time delay as to vacuum loss in chamber 62 relative to that in the entire chamber 68.

Figure 3:
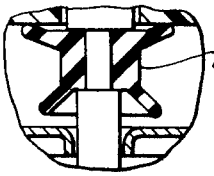
FIG. 3 is a schematic fragment showing of a poppet valve of the timer means of FIG. 2 in a "closed" position.
Figure 4:
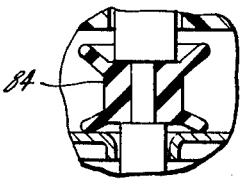
FIG. 4 is a schematic fragment showing a poppet valve of the timer means of FIG. 2 in an "open" position.

A third diaphragm 80 comprises a vacuum motor means along with a stem 82 which interconnects between diaphragm 80, a resilient poppet valve 84 and a biasing spring 86, which is arranged to place poppet valve 84 in a normally closed position (not shown fully "closed" or "open" in FIG. 2) relative to a passage 59 between conduit 58*b* and output conduit 90. The passage is opened when poppet valve 84 is moved downwardly to an open position as shown in FIG. 4 and closed when poppet valve 84 is moved upwardly as shown in FIG. 3, to establish passage of manifold vacuum from conduit 58*b* and inlet 56 to output 90 and output outlet 92 when vacuum is established in accumulator chamber 68*d* and diaphragm 80 via passage 68*e* and is actuated to move stem 82 and hence poppet valve 84 to the open position establishing this passage and making possible the appearance of manifold vacuum at the output 92. As can be seen from the above description the vacuum output is provided in a delayed fashion due to the structural arrangement of the device. Time delay means 50 as shown in FIG. 2 is in a condition such that there is no output although there is input, essentially a timing condition.

The operation of the device as to its time delay feature and its reset feature is as follows in the context of an EGR system. With no manifold vacuum, i.e., the engine is not running, diaphragm 64 is normally open, i.e., unseated with respect to manifold vacuum nozzle 60. Diaphragm 72 is unseated, normally open, with respect to reset nozzle 74. Actuator diaphragm 80 is inactive relative to biasing spring 86 hence the spring overrides diaphragm and places poppet valve 84 in its normally closed position.

Once the engine is started a manifold vacuum is produced and appears at inlet 56 and in conduit 58. Diaphragm 72 substantially immediately seats against reset nozzle 74 (shown in position in FIG. 2) sealing accumulator chamber 68*b* at that point. The manifold vacuum begins to evacuate through interconnecting means 70 chamber 68 to a point where the manifold vacuum overcomes the spring load provided by biasing spring 66 and causes diaphragm 64 to seat against manifold vacuum nozzle 60 (shown in this position) sealing evacuated chambers 62 and 68 from the atmosphere and from the manifold vacuum. However, at this point the vacuum level in first chamber 62, is higher than the vacuum level in the second chamber i.e., accumulator chamber 68, due to the delayed evacuation of chamber 68 by interconnecting bleed means 70. Thus, the vacuum level in 68 is not initially at a sufficient level to actuate diaphragm 80 and move poppet valve 84 to an open position against biasing spring 86. As the vacuum builds up in the accumulator over a time period, which may be predetermined by design parameters, in the accumulator by the controlled bleeding action through means 70 the vacuum level reaches a point at which it actuates diaphragm 80 due to the vacuum level at 68*d* and causes poppet valve 84 to move to the open position thereby allowing the passage of manifold vacuum through conduit 58*b*, 59 and 90 to output 92.

If the engine should be turned off or if it should stall, diaphragm 72 immediately unseats with respect to reset nozzle 74 due to the loss of vacuum input and vents accumulator chamber 68 and first vacuum chamber 62 to the manifold vacuum conduit 58 via 58*c* thus making it necessary to reevacuate both chambers when the engine is once again started thereby providing a resettable time delay function.

It can be seen that by connecting time delay device 50 into the control system shown in FIG. 1, with inlet 56 connected to 22*a* of FIG. 1 and output 92 connected to 22*b* of FIG. 1, manifold vacuum source means 14 can provide vacuum in conduit 22 and 42 only after passage of a timed delay period. Thus, any operation of amplifier 16 and EGR valve 12 or idle enrichment regulator 32 via vacuum bleed 34 are postponed upon starting of the engine for a predetermined period such as the heretofore mentioned 35 second delay interval.

It should be noted that the reset mechanism vents accumulator chamber 68 to the manifold vacuum rather than to atmosphere. Venting to atmosphere is undesirable since a leak would prevent vacuum buildup in the accumulator chamber causing the loss of EGR resulting in an emission failure during operation of the engine.

An advantage of the reset arrangement described above lies in the fact that a leak at the vent seal diaphragm 72 of nozzle 74 would not cause the loss of EGR. Thus the arrangement is fail-safe in favor of EGR and emissions. The reason for the fail safe characteristic is that a leak from manifold vacuum to the accumulator chambers would be in parallel with the delay restriction 70.

What is claimed is:

1. A vacuum control system for internal combustion engines, comprising:

vacuum operated means associated with an engine, the vacuum operated means being adapted to provide vacuum signals to the engine for control purposes, engine manifold vacuum source means operable to provide a vacuum input to the vacuum operated means, and vacuum delay means operable to delay transmission of the vacuum input provided by the manifold vacuum source means to the vacuum operated means as a vacuum output for a predetermined period of time after engine start-up, carburetor idle enrichment means comprising a vacuum operated, normally open, air bleed valve means, temperature operated, normally open below a predetermined temperature, vacuum control valve means including operating input and output means, first vacuum conduit means connecting the vacuum control valve input means to the engine manifold vacuum source means for providing a vacuum signal to the valve, second vacuum conduit means comprising the vacuum control valve output means to the idle enrichment means for providing a vacuum signal to the idle enrichment means, and normally closed vacuum response vacuum relief means connected between the idle enrichment means and the temperature operated valve means in the second vacuum conduit, the relief means being operable to an open condition by the vacuum signal provided by the vacuum delay means.

2. An exhaust gas recirculating control system for internal combustion engines whereby exhaust gas is recirculated to the engine combustion chambers in order to decrease exhaust gas emissions of $NO_x$, the system comprising:

engine manifold vacuum source means for providing a vacuum signal, vacuum delay means responsive to the vacuum signal to provide a time delayed vacuum control signal, vacuum control means connected to the vacuum delay means and operable in response to the vacuum control signal to provide an operating vacuum signal, a vacuum operated EGR valve connected to the control means and operable in response to the operating vacuum signal, carburetor idle enrichment means comprising a vacuum operated, normally open, air bleed valve means, temperature operated, normally open below a predetermined temperature, vacuum control valve means including operating input and output means, first vacuum conduit means connecting the vacuum control valve input means to the engine manifold vacuum source means for providing a vacuum signal to the valve, second vacuum conduit means connecting the vacuum control valve output means to the idle enrichment means for providing a vacuum signal to the idle enrichment means, and normally closed vacuum responsive vacuum relief means connected between the idle enrichment means and the temperature operated valve means in the second vacuum conduit, the relief means being operable to an open condition by the operating vacuum signal provided by the vacuum delay means.

* * * * *